US007040940B2

(12) United States Patent
Mueller

(10) Patent No.: US 7,040,940 B2
(45) Date of Patent: May 9, 2006

(54) ROTATABLE LIFTING SURFACE DEVICE HAVING SELECTED PITCH DISTRIBUTION AND CAMBER PROFILE

(75) Inventor: A. Christopher Mueller, Virginia Beach, VA (US)

(73) Assignee: AB Volvo, Gothenburg (SE)

( * ) Notice: Subject to any disclaimer, the term of this patent is extended or adjusted under 35 U.S.C. 154(b) by 0 days.

(21) Appl. No.: 10/827,857

(22) Filed: Apr. 20, 2004

(65) Prior Publication Data

US 2005/0233654 A1 Oct. 20, 2005

(51) Int. Cl.
*B63H 1/14* (2006.01)

(52) U.S. Cl. ..... 440/49; 416/223 A; 416/230

(58) Field of Classification Search ..... 440/49, 440/50; 416/223 R, 240, 241 R, 241 A, 416/134 R
See application file for complete search history.

(56) References Cited

U.S. PATENT DOCUMENTS

| | | | | |
|---|---|---|---|---|
| 3,318,388 A | | 5/1967 | Bihlmire | |
| 4,797,066 A | * | 1/1989 | Stromberg | 416/230 |
| 4,842,483 A | | 6/1989 | Geary | |
| 5,108,262 A | | 4/1992 | Crane | |
| 5,275,535 A | | 1/1994 | Gongwer | |
| 6,371,726 B1 | | 4/2002 | Jonsson et al. | |
| 6,468,119 B1 | | 10/2002 | Hasl et al. | |
| 6,837,760 B1 | * | 1/2005 | Mackey | 440/49 |

FOREIGN PATENT DOCUMENTS

| | | |
|---|---|---|
| DE | 196 47 102 | 5/1998 |
| EP | 0 254 106 A1 | 1/1988 |
| EP | 0 295 247 B1 | 12/1988 |
| EP | 1 327 579 | 7/2003 |
| JP | 11-180394 | 7/1999 |
| JP | 11-314598 | 11/1999 |
| WO | WO 93/09027 | 5/1993 |

OTHER PUBLICATIONS

International Search Report, Sep. 9, 2005, European Patent Office.
Written Opinion of the International Searching Authority, Sep. 9, 2005, European Patent Office.

* cited by examiner

*Primary Examiner*—Jesus D. Sotelo
(74) *Attorney, Agent, or Firm*—Potomac Patent Group PLLC

(57) ABSTRACT

Rotatable lifting surface devices, such as propellers, impellers, and turbines, and blades for such devices use camber profiles and pitch distributions to obtain performance from flexible devices and blades, made from materials like polymers and polymer-composites and even metals, that is substantially the same as the performance of stiff devices and blades, usually made from materials like steel and aluminum.

31 Claims, 4 Drawing Sheets

ROTATABLE LIFTING SURFACE DEVICE HAVING SELECTED PITCH DISTRIBUTION AND CAMBER PROFILE

BACKGROUND

This invention relates to turbines, impellers, propellers, and the like, and particularly to propellers for water craft.

The search for propellers having low cost and yet good performance is ongoing. As described in U.S. Pat. No. 6,371,726 to C. Jonsson et al., the general design goal of a propeller is high performance, i.e., high forward thrust or propeller efficiency at any speed. One approach to this goal is a large propeller diameter in combination with a low drive-shaft speed, with blades having optimal radial (hub to tip) load distributions, areas large enough to avoid cavitation, and thin cambered sections of the airfoil type.

Traditional materials used for propellers for marine applications, such as steel, aluminum, and bronze, provide good strength and stiffness but now can be more expensive than newer composite and plastic or polymer materials that have been used in propellers for some time. Nevertheless, the performance of such newer materials in applications like the marine application has generally been poor.

Some composite materials, such as hand-laid fiber-reinforced composites and resin-transfer-molded composites, have shown promise, but they are so expensive that they can cost more than a molded aluminum propeller. The flexural strength of composites and polymers also is often not high enough to obtain performance equivalent to a metal propeller. Plastic polymer or plastic-composite propellers may have the required strength, but they often do not have the stiffness needed to replace metals like aluminum with equivalent performance. Because composites deflect under load, the performance of a composite propeller can suffer because its shape can differ from the optimal shape.

A useful goal is a propeller or a propeller blade, which is part of a propeller assembly, that is made of a light and flexible material and that yet performs substantially the same as propellers or propeller blades made of stiffer materials, for example, aluminum. Prior attempts to reach this goal have been unsuccessful.

European Patent Publication EP 0 295 247 discloses a propeller made of an expensive hand-laid composite polymer-matrix material. The propeller is elastically deformable, and thus the pitch, which is the distance a cylindrical section of the propeller ideally moves in one rotation, varies under load. The pitch is controlled by carefully making the propeller stronger or weaker at predetermined places on the blades. A beam is used to support a propeller blade in the radial or span-wise direction of the blade, thus providing additional strength and resistance to bending in that direction.

Patent Abstracts of Japan Publications No. JP 11-314598 and No. JP 11-180394 describe propellers made from reinforced resin materials that allow the propellers' pitch to change under load. Publication No. JP 11-314598 describes strengthening propeller blades in certain directions by suitably orienting the reinforcing fibers, and although it mentions blade deflections, the Publication does not address the issues of camber, pitch, and optimum pitch to get optimum performance.

U.S. Pat. No. 3,318,388 to Bihlmire discloses a metal/plastic composite propeller, where the plastic is molded over the metal, that allows the propeller's pitch to alter under load. Other propellers made from polymer materials are described in U.S. Pat. No. 5,275,535 and No. 4,842,483 and European Patent Publication No. EP 0 254 106.

None of the above-cited documents discusses any particular combination of pitch distribution and camber profile of a flexible propeller or propeller blade that enables the propeller or blade to deflect into an optimum design pitch distribution at design and off-design conditions.

SUMMARY

Applicant's propellers and propeller blades use novel camber profiles and pitch distributions to obtain performance from flexible propellers and propeller blades, made from materials like polymers and polymer-composites and even metals, that is substantially the same as the performance of stiff propellers and blades, usually made from materials like steel and aluminum.

In accordance with one aspect of Applicant's invention, a rotatable lifting surface device includes a hub and a plurality of blades extending from the hub. A blade is formed of a material that is flexible, has a pitch distribution across a span of the blade, and has a camber profile at at least one radial station of the blade such that the blade is loadable toward a trailing edge of the blade and that the blade is deflectable from a first position in which a load on the device is low and the pitch distribution is a first pitch distribution, such that a pitch of the blade increases from the hub to a tip of the blade, to a second position in which the load on the device is an intended load and the pitch distribution is a second pitch distribution different from the first pitch distribution.

In accordance with another aspect of the Applicant's invention, a water craft includes a hull, an engine disposed in the hull, and at least one propeller driven by the engine. The propeller includes a hub and a plurality of blades extending from the hub. A blade is formed of a material that is flexible, has a pitch distribution across a span of the blade, and has a camber profile at at least one radial station of the blade such that the blade is loadable toward a trailing edge of the blade and that the blade is deflectable from a first position in which a load on the propeller is low and the pitch distribution is a first pitch distribution, such that a pitch of the blade increases from the hub to a tip of the blade, to a second position in which the load on the propeller is an intended load and the pitch distribution is a second pitch distribution different from the first pitch distribution.

BRIEF DESCRIPTION OF THE DRAWINGS

The various features, objects, and advantages of Applicant's invention will be understood by reading this description in conjunction with the drawings, in which.

DETAILED DESCRIPTION

It will be understood that this description focusses on a marine application simply for convenience of explanation. It is believed Applicant's invention can be applied in other applications, for example, pumps and turbines for various fluids, such as water, oil, etc. This application uses the term rotatable lifting surface device to encompass propellers, impellers, turbines, and similar devices.

The blades of rotating lifting surface devices, like propellers, in accordance with Applicant's invention are flexible and have pitch distributions and camber profiles such that the blades are deflected into optimal position when the propellers are operating at their intended design conditions. As explained in more detail below, this requires special combinations of pitch distribution and camber profile. For example, the camber profile of each blade may have its maximum at a position past the 60% chord position.

Figure 1:
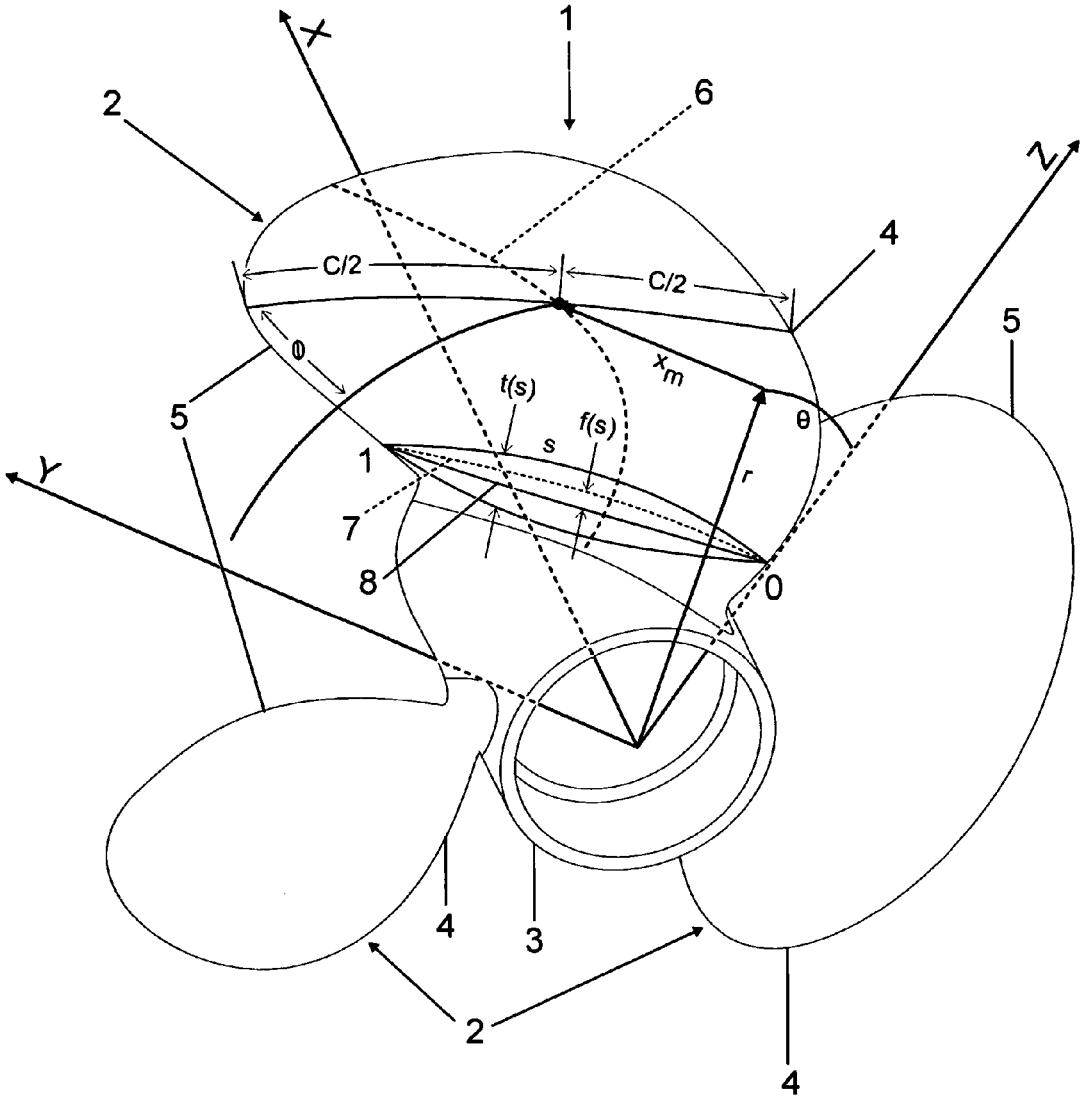
FIG. 1 depicts a propeller.

FIG. 1 depicts a propeller 1 for a boat or water drive system that includes a plurality of blades 2, each of which is connected to a hub 3 and has a leading edge 4 and a trailing edge 5. The blades and hub may be integrally formed or each blade may be attached to the hub, for example, in a respective recess in the hub, as described for example in U.S. Pat. No. 6,371,726 cited above.

Also shown in FIG. 1 are mutually perpendicular axes x, y, z that define a Cartesian coordinate system for describing the geometry of the propeller 1. The x-axis is co-linear with the axis of the substantially cylindrical hub 3 (which is apparent from the broken-line portion of the axis). If it is imagined that the blades continue from their tips through the hub to the x-axis, then the y-z plane may be defined such that it includes those points on the leading edges of the blades where the blades contact the hub. It will be understood that identifying the leading edges in this way implies that the propeller rotates about the x-axis in a clockwise direction, i.e., as if the y-axis rotates into the z-axis, as they are shown. As indicated in FIG. 1, a point in the x-y-z space, such as a point on a blade 2, can also be located in a cylindrical coordinate system by specifying an angle θ from the y-axis, a distance r in the y-z plane, and a height $x_m$ above the y-z plane. It will be appreciated that selection of such coordinate systems is arbitrary and that other coordinate systems may be used instead.

A locus of points called a generatrix may be defined on the chord line of each section; the generatrix splits the chord of each section and is equidistant from the leading and trailing edges. In FIG. 1, one generatrix is indicated by the broken line 6 and one of the chord lines is indicated by the broken line 7. Each point on the generatrix 6 can be defined in the cylindrical coordinate system by indicating the radial distance r from the hub axis, the angle θ from the x-y plane, and the x-coordinate $x_m$. A propeller defined in this manner having a non-constant value of θ is said to be skewed, and a propeller having a non-constant value of $x_m$ is said to have rake. A propeller geometry, including the generatrix, is typically defined at discretized stations r/R, where R is the total radius of the propeller. Thus, the tip of the blade is located at r/R=1.0 and the hub axis is located at r/R=0.0. A chord line is a locus of points that connects the leading and trailing edges along a helix located at a constant radial position r. A chord line is split into equal segments by the generatrix, and FIG. 1 shows two such segments having length C/2, and thus the full length of the chord line is C.

FIG. 1 also shows a section through a blade at one station. The section has a thickness t(s) through the blade that typically varies with the station and with the position along the chord line at that station. For example, the maximum chord-wise thickness near the hub may be 0.75 inch (in) or 19 millimeters (mm), and 0.5 in or 12.7 mm at the r/R=0.5 station, and 0.0625 in/1.6 mm near the tip. As shown in FIG. 1, the chord line 7 may be used to identify positions along a chord-wise direction of the blade, and these positions may be conveniently identified relative to the full length c of the chord line, so that the leading edge of the blade is at position 0.0 and the trailing edge is at position 1.0. These positions are indicated in FIG. 1.

A section of a blade also has a camber profile or camber line, one of which is indicated in FIG. 1 by the solid line 8. A camber line is a locus of points between the leading and trailing edges that are equidistant from the surfaces of the blade at a given radial station. As depicted in FIG. 1, a camber line 8 may depart from the chord line 7 at that station, and the distance between these lines may be represented by a parameter f(s) that varies with position along the chord line. This relationship may be better seen in FIG. 2, which shows a section of a blade 2 having leading and trailing edges 4, 5, chord line 7, and camber line 8. The camber profiles at different stations of a blade are typically, but not necessarily, substantially the same.

From FIG. 1, it can be seen that the pitch angle ϕ of a blade at a particular radial station is just the angle formed between the chord line at that station and a plane that is parallel to the y-z plane. As noted above, the pitch is the distance traveled by a helix rotating through 360° and passing through the leading and trailing edges of a blade at a particular radial station. If one knows the pitch, one can readily determine the pitch angle, and vice versa.

Applicant has recognized that design and performance problems presented by propellers and blades made of flexible materials can be solved by choosing a pitch distribution across the span of the blade and a camber profile along each blade such that, in combination, the intended load causes the propeller pitch to deflect into the optimum or near-optimum geometry for a set of operating conditions, which for a boat may include load in the boat, engine torque, speed relative to the water, etc. that affect the in-flow conditions of the propeller.

Figure 2:
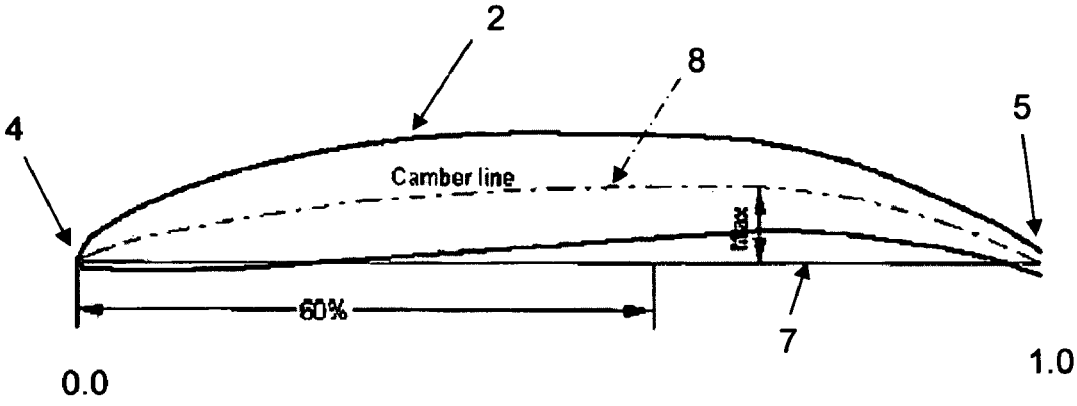
FIG. 2 illustrates propeller and blade geometry.

In particular, Applicant's camber profile has its maximum at a chord-line position that is past the 0.6 chord position, measured from the leading edge, at each radial station of the blade. This is depicted in FIG. 2 for one radial station. The maximum camber position is the point or points at which the camber line 8 is farthest from the chord line 7, e.g., the position at which f(s) is maximum. Maintaining the camber maximum past the 0.6 chord position ensures that the blade is loaded near the trailing edge, which in turn ensures that a flexible blade will deflect such that its pitch decreases under load, even at off-design conditions. It is currently preferred that the point of maximum camber at one or more radial stations on the blade be between 65% and 95% of the respective radial position's chord length. At much less than 65%, the blade is not likely to be loaded properly at off-design conditions, and at much more than 95%, the blade will suffer efficiency losses due to its insufficiently gradual, or smooth, camber profile.

It should be understood that loading the trailing edge in this way is unconventional because it produces uneven loading on the blade along each chord-wise section, which can lead to large pressure drops that incite cavitation on the blade. This is normally avoided by the propeller designer as it can have adverse effects on efficiency and propeller longevity. Nevertheless, various materials such as those described below have excellent resilience against cavitation erosion, and thus the usual requirement to avoid cavitation can be substantially ignored. The deflection of a propeller or blade made of a flexible material would be difficult to control if it used a traditional cambered section having the maximum located more toward the leading edge than what is indicated in this application. Rather than deflecting into a more optimal position, such a propeller blade can deflect into an even less optimal position.

Applicant has further recognized that the pitch of the propeller should have a radial distribution such that the pitch increases gradually and more or less continuously from the hub to the blade tip, preferably with total increases in pitch of between about 10% and about 30%. The blade is shaped such that portions of the blade that are near the hub, e.g., at stations around r/R=0.3, are at or near the intended optimum pitch. The pitch gradually increases along the span of the propeller to a point at least at about the r/R=0.9 position, i.e., 90% of the total radius, where the pitch reaches its maximum. As just described, the maximum pitch may be between about 110% and about 130% of the pitch at the hub, depending on the material and the operating conditions. In this way, when operating in water, or another intended fluid, the propeller deflects into the intended pitch distribution, i.e., substantially 100% of the intended optimum pitch substantially all along the span, giving substantially optimal performance for the propeller.

It should also be understood that having a radially-increasing-pitch distribution even if mainly under low/no-load operating conditions in this way is also not likely to be favored by the typical propeller designer, who knows that a constant pitch, like the pitch of the threads of a screw for driving into wood, or a decreasing pitch makes it easier for the propeller to move through its medium. Furthermore, a radially-increasing-pitch distribution is contrary to the common design strategy to decrease the pitch of a propeller blade near the tip in order to unload the propeller at the tip and thus avoid vibration or tip-induced vortex cavitation.

Applicant's invention addresses the problem of off-design operation by using a selected combination of pitch distribution and camber profile to ensure that even at off-design conditions, such as slightly more or less angle of attack on the propeller blades, the blades deflect into the optimal position. Suitable propellers and blades can be designed in a number of ways, but computerized tools are currently believed to be most advantageously used in an iterative design process. For example, the PROPCAV software, which is available through a consortium led by the University of Texas at Austin, is useful for determining the pressures at different points on a proposed propeller or blade. PROPCAV is a panel (or boundary element) method that handles fully wetted and cavitating conditions in non-axisymmetric in-flow, generating accurate representations of the flow at the leading edge, tip, and root of a propeller blade since the hub is also paneled. The method includes mid-chord back or face cavity detachment and treats separate cavities on the two sides of the blade. These results are usable with methods of finite-element analysis, such as the ADINA System, which is available from ADINA R&D, Inc., Watertown, Mass., and which is a program for comprehensive finite element analyses of structures, fluids, and fluid flows with structural interactions.

Figure 3A:
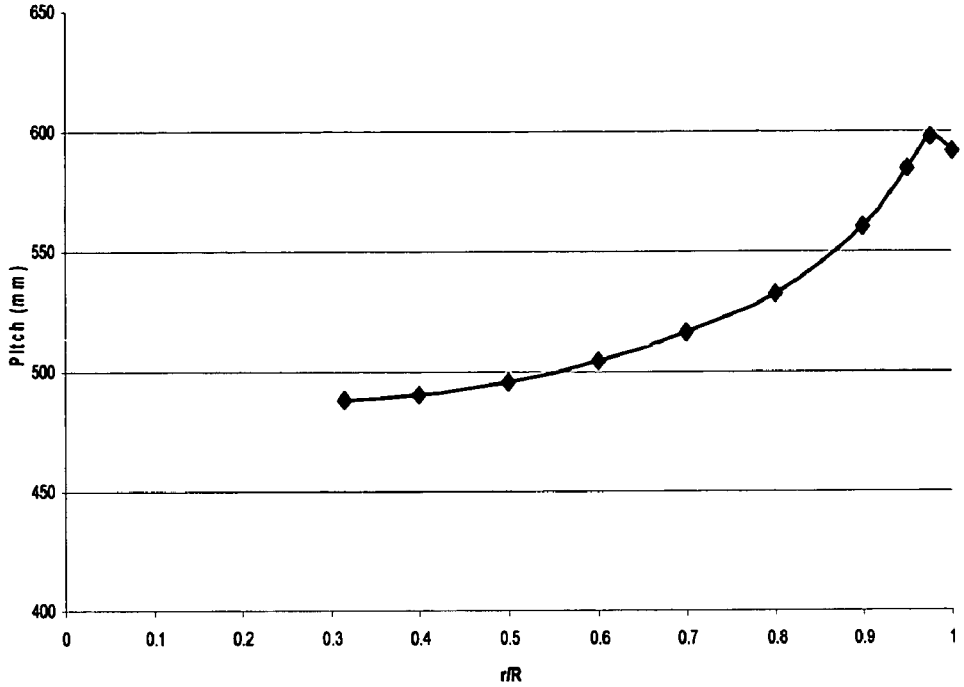
FIGS. 3A, 3B and 4A, 4B are plots of the pitches of two blades in accordance with Applicant's invention.
Figure 3B:
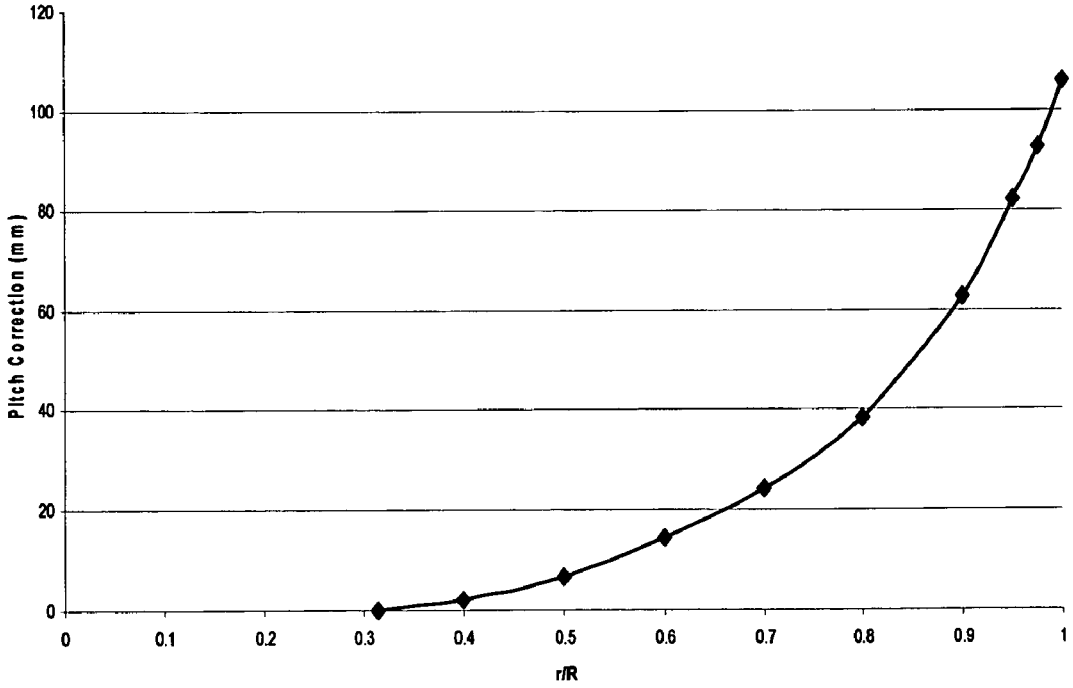
Figure 4A:
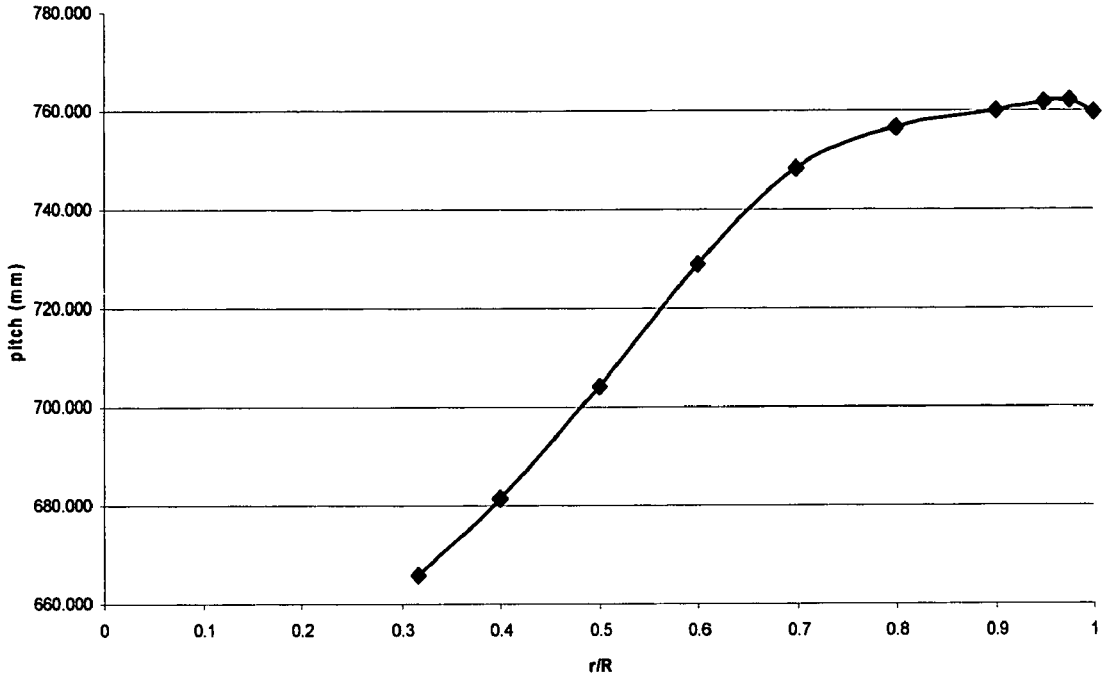
Figure 4B:
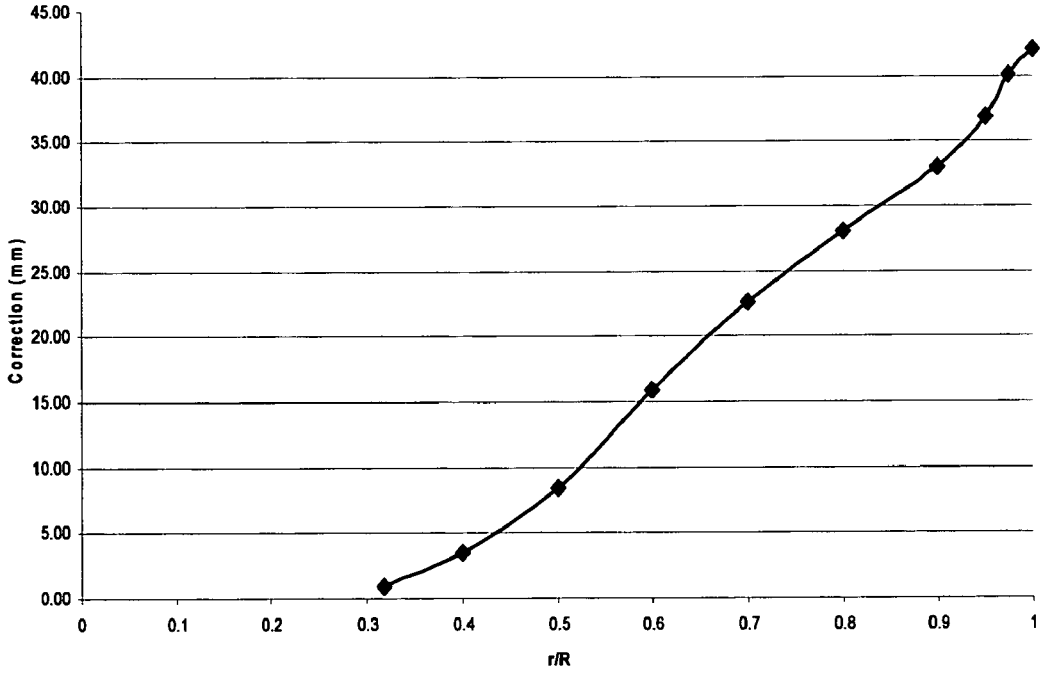

FIGS. 3A, 3B and 4A, 4B are plots of the pitches of two blades generated by these methods. FIGS. 3A and 4A show final designs that have undergone correction for deflections due to the materials of the blades. FIGS. 3B and 4B show how much correction was actually applied to arrive at the respective final designs. Those of skill in this art will understand that these corrections were determined by calculations at discretized sections of the blade, which is attached to the hub at station r/R=0.3. Considering FIGS. 3A and 3B, the pitch near the tip in the no/low load condition, i.e., before correction, is about 122% of the pitch near the hub. Considering FIGS. 4A and 4B, the pitch near the tip in the no/low load condition before correction is about 115% of the pitch near the hub.

Applicant's propellers and blades are thus necessarily flexible and can be made from many materials that are light yet strong and inexpensive. For water applications, particularly useful materials appear to be plastic polymers and polymer-composite materials. It is currently believed that a particularly useful material is a plastic-composite material of approximately 50% glass fiber and approximately 50% polymer, but materials of more or less than 50%, including zero percent, glass fiber content can be used. Suitable materials are commercially available from a number of manufacturers, including for example LNP Engineering Plastics, Inc., Exton, Pa., which makes Verton® Long Glass Fiber Reinforced composites, which combine nylon, polypropylene, polyphthalamide, polyester (PBT), ABS and other engineering thermoplastics with long glass fibers. Although long glass fibers are used as reinforcing fibers in such materials, other fibers, such as short glass fibers, carbon fibers, or boron-tungsten fibers or wires, could be useful as reinforcing fibers in a polymer or resin matrix or vice versa. Plastics, polymers, resins, and composites are low-cost alternatives to aluminum and have several other advantages, including resistance to cavitation erosion and the enablement of replaceable blades.

While having good strength, these materials are so flexible that a propeller's performance under load is different from its performance under low/no load. These materials are advantageous in that propellers and blades can be made by injection molding, which is an inexpensive production method. Blades may be molded into a propeller's hub by, for example, molding the hub and blades in one molding operation, or blades may be molded individually and mounted or affixed to a separate hub after molding.

Besides injection molding of polymers and polymer-composites, suitable propellers and blades can be made with other materials and methods, such as resin transfer molding, although resin transfer molding is relatively more expensive than injection molding.

Applicant's propellers and blades can be used in marine applications with any engine configuration. As described in U.S. Pat. No. 6,468,119 to E. Hasl et al., boats are often driven by either inboard engines, or outboard engines, or inboard/outboard engines. In the inboard configuration, the engine is typically positioned within a compartment on the boat and a drive shaft extends through the bottom of the boat's hull, with the propeller positioned such that the propeller and part of the drive shaft are in the water during normal operation. An outboard engine is a self-contained unit that is often attached to the transom of a boat and includes an engine that is positioned within a cowling, at least one propeller attached to a lower unit, and a drive shaft in a housing that extends in a generally vertical direction between the engine and the lower unit. The lower unit typically contains gears for transferring drive-shaft torque to a propeller shaft that is generally oriented perpendicularly to the drive shaft. The inboard/outboard configuration is a hybrid of the inboard and outboard configurations that generally includes an engine positioned in a compartment, like the inboard configuration, that is typically located proximate the transom of the boat, like the outboard configuration. The inboard/outboard engine also includes a drive assembly that resembles the lower unit of an outboard engine.

Figure 5:
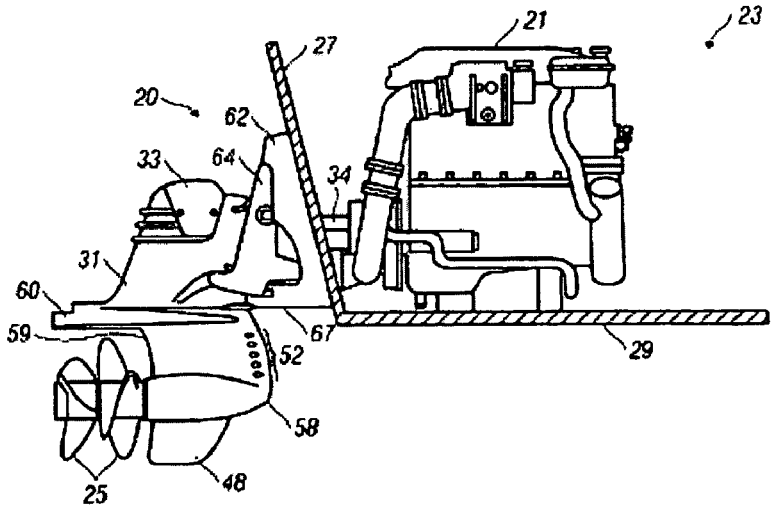
FIG. 5 is a cross-section of a portion of a boat, showing an inboard/outboard engine and propellers.

Referring to FIG. 5, which depicts an inboard/outboard configuration as shown in U.S. Pat. No. 6,468,119 cited above, a drive assembly 20 is installed on a boat 23 proximate to the boat's transom 27 and is coupled between an engine 21 that is mounted to a hull 29 of the boat and at least one propeller 25. Engine 21 can be a gasoline engine, a diesel engine, or other mechanical-power generating engine. Further, the engine 21 may be cooled by an air cooling system, a closed-loop water system, or an open-loop system using water taken from the body of water in which the boat 23 floats. In addition, the boat 23 is not limited to a particular size, model, or application. The drive assembly 20 may include a drive housing 31 with a skeg 48, raw water pickup ports 52 positioned near a front edge 58 for receiving water for the engine cooling system, a rear edge 59, and an anti-cavitation plate 60. A gimbal ring 64 is pivotably mounted to a shield assembly 62 that allows the gimbal ring 64 and drive housing 31 to rotate for steering purposes. The shield assembly 62 also includes an exhaust water outlet 67.

Applicant's invention may be embodied in many different forms, not all of which are described above, and all such forms are contemplated to be within the scope of the invention. For example, although FIG. 1 shows a propeller having three blades, the propeller can have two or more blades, it being recognized that a three- or more-blade propeller may be easier to balance than a two-blade propeller. Also, it should be recognized that since all blades of a propeller may be identical, the manufacturing of the blades is greatly simplified, but this is not required.

It is emphasized that the terms "comprises" and "comprising", when used in this application, specify the presence of stated features, steps, or components and do not preclude the presence or addition of one or more other features, steps, components, or groups thereof.

The particular embodiments described above are merely illustrative and should not be considered restrictive in any way. The scope of Applicant's invention is determined by the following claims, and all variations and equivalents that fall within the range of the claims are intended to be embraced therein.

What is claimed is:

1. A rotatable lifting surface device, comprising a hub and a plurality of blades extending therefrom, wherein a blade is formed of a material that is flexible, has a pitch distribution across a span of the blade, and has a camber profile at at least one radial station of the blade such that the blade is loadable toward a trailing edge of the blade and that the blade is deflectable from a first position in which a load on the device is low and the pitch distribution is a first pitch distribution, such that a pitch of the blade increases from the hub to a tip of the blade, to a second position in which the load on the device is an intended load and the pitch distribution is a second pitch distribution different from the first pitch distribution, and the camber profile has its maximum camber nearer the trailing edge of the blade at a chord-line position that is at least about sixty percent of a chord length at substantially all radial stations of the blade.

2. The device of claim 1, wherein the camber profile has its maximum camber nearer the trailing edge of the blade at a chord-line position that is at least about sixty percent and less than about ninety-five percent of a chord length of the blade.

3. The device of claim 2, wherein the first pitch distribution is such that the pitch increases between about 10% and about 30% from the hub to the tip.

4. The device of claim 3, wherein pitch values of the second pitch distribution are less than pitch values of the first pitch distribution at at least a majority of radial stations of the blade.

5. The device of claim 4, wherein the blade is formed of at least one of a plastic polymer and a polymer-composite.

6. The device of claim 1, wherein the intended load corresponds to a set of operating conditions that is based on in-flow conditions of the device.

7. The device of claim 1, wherein the first pitch distribution is such that the pitch increases between about 10% and about 30% from the hub to the tip, and pitch values of the second pitch distribution are less than pitch values of the first pitch distribution at at least a majority of radial stations of the blade.

8. The device of claim 7, wherein the first pitch distribution is such that the pitch of portions of the blade that are near the hub is substantially the same as a pitch of the second pitch distribution.

9. The device of claim 1, wherein pitch of the first pitch distribution gradually increases along the span to at least about 90% of a total radius of the device.

10. The device of claim 1, wherein the blade is formed of at least one of a plastic polymer and a polymer-composite.

11. The device of claim 10, wherein the polymer-composite comprises approximately 50% glass fiber and approximately 50% polymer.

12. A water craft, comprising a hull; an engine disposed in the hull; and at least one propeller driven by the engine; wherein the at least one propeller comprises a hub and a plurality of blades extending therefrom; and a blade is formed of a material that is flexible, has a pitch distribution across a span of the blade, and has a camber profile at at least one radial station of the blade such that the blade is loadable toward a trailing edge of the blade and that the blade is deflectable from a first position in which a load on the propeller is low and the pitch distribution is a first pitch distribution, such that a pitch of the blade increases from the hub to a tip of the blade, to a second position in which the load on the propeller is an intended load and the pitch distribution is a second pitch distribution different from the first pitch distribution, and the camber profile has its maximum camber at a chord-line position that is at least about sixty percent of a chord length at substantially all radial stations of the blade.

13. The water craft of claim 12, wherein the first pitch distribution is such that pitch increases between about 10% and about 30% from the hub to the tip.

14. The water craft of claim 13, wherein the first pitch distribution is such that pitches of portions of the blade that are near the hub are substantially the same as a pitch of the second pitch distribution, and pitch values of the second pitch distribution are less than pitch values of the first pitch distribution at at least a majority of radial stations of the blade.

15. The water craft of claim 12, wherein the camber profile has its maximum camber nearer the trailing edge of the blade at a chord-line position that is at least about sixty percent and less than about ninety-five percent of a chord length of the blade, and pitch values of the second pitch distribution are less than pitch values of the first pitch distribution at at least a majority of radial stations of the blade.

16. The water craft of claim 12, wherein the intended load corresponds to a set of operating conditions that is based on in-flow conditions of the propeller.

17. The water craft of claim 16, wherein the set of operating conditions includes at least one of a load in the hull, engine torque, and speed relative to water.

18. The water craft of claim 12, wherein the first pitch distribution is such that pitch gradually increases along the span to at least about 90% of a total radius of the propeller.

19. The water craft of claim 12, wherein the blade is formed of at least one of a plastic polymer and a polymer-composite.

20. The water craft of claim 19, wherein the polymer-composite comprises approximately 50% glass fiber and approximately 50% polymer.

21. A rotatable lifting surface device, comprising a hub and a plurality of blades extending therefrom, wherein a blade is formed of a material that is flexible, has a pitch distribution across a span of the blade, and has a camber profile at at least one radial station of the blade such that the blade is loadable toward a trailing edge of the blade and that the blade is deflectable from a first position in which a load on the device is low and the pitch distribution is a first pitch distribution, such that a pitch of the blade increases from the hub to a tip of the blade, to a second position in which the load on the device is an intended load and the pitch distribution is a second pitch distribution different from the first pitch distribution, and the first pitch distribution is such that the pitch increases between about 10% and about 30% from the hub to the tip, and pitch values of the second pitch distribution are less than pitch values of the first pitch distribution at at least a majority of radial stations of the blade.

22. The device of claim 21, wherein the camber profile has its maximum camber nearer the trailing edge of the blade at a chord-line position that is at least about sixty percent of a chord length at substantially all radial stations of the blade.

23. The device of claim 21, wherein the camber profile has its maximum camber nearer the trailing edge of the blade at a chord-line position that is at least about sixty percent and less than about ninety-five percent of a chord length of the blade.

24. The device of claim 23, wherein the first pitch distribution is such that the pitch increases between about 10% and about 30% from the hub to the tip.

25. The device of claim 24, wherein pitch values of the second pitch distribution are less than pitch values of the first pitch distribution at at least a majority of radial stations of the blade.

26. The device of claim 25, wherein the blade is formed of at least one of a plastic polymer and a polymer-composite.

27. The device of claim 21, wherein the intended load corresponds to a set of operating conditions that is based on in-flow conditions of the device.

28. The device of claim 21, wherein the first pitch distribution is such that the pitch of portions of the blade that are near the hub is substantially the same as a pitch of the second pitch distribution.

29. The device of claim 21, wherein pitch of the first pitch distribution gradually increases along the span to at least about 90% of a total radius of the device.

30. The device of claim 21, wherein the blade is formed of at least one of a plastic polymer and a polymer-composite.

31. The device of claim 30, wherein the polymer-composite comprises approximately 50% glass fiber and approximately 50% polymer.

* * * * *